US006575598B2

(12) United States Patent
Weigert et al.

(10) Patent No.: US 6,575,598 B2
(45) Date of Patent: Jun. 10, 2003

(54) FOCUSABLE SPOTLIGHT WITH A NEGATIVE LENS

(75) Inventors: Dedo Weigert, Munich (DE); Depu Chin, Munich (DE)

(73) Assignee: Dedo Weigert Film GmbH, Munich (DE)

( * ) Notice: Subject to any disclaimer, the term of this patent is extended or adjusted under 35 U.S.C. 154(b) by 0 days.

(21) Appl. No.: 10/020,243

(22) Filed: Dec. 18, 2001

(65) Prior Publication Data

US 2002/0114160 A1 Aug. 22, 2002

(30) Foreign Application Priority Data

Dec. 18, 2000 (DE) ..... 100 63 134

(51) Int. Cl.[7] ..... F21V 5/00

(52) U.S. Cl. ..... 362/268; 362/308; 359/366; 359/728

(58) Field of Search ..... 362/268, 308; 359/366, 728

(56) References Cited

U.S. PATENT DOCUMENTS

| | | | | | |
|---|---|---|---|---|---|
| 1,338,818 | A | * | 5/1920 | Dennington | 362/268 |
| RE31,003 | E | * | 7/1982 | Lemons | 362/287 |
| 4,519,020 | A | * | 5/1985 | Little | 362/268 |
| 4,823,243 | A | * | 4/1989 | Weigert | 362/307 |
| 6,046,856 | A | * | 4/2000 | Takahashi et al. | 362/268 |

* cited by examiner

*Primary Examiner*—Sandra O'Shea
*Assistant Examiner*—Ismael Negron
(74) *Attorney, Agent, or Firm*—Birch, Stewart, Kolasch & Birch, LLP

(57) ABSTRACT

A spotlight has a curved reflector (1, 1') and a lamp (2, 2') arranged inside a cavity formed by the reflector (1, 1'). The lamp (2, 2') and the reflector (1, 1') are movable relative to one another in a direction of a main optical axis of the spotlight. A converging lens (5) is arranged in front of the reflector (1, 1') in a direction of light emission. A dispersive lens (6) is arranged between the reflector (1, 1') and the converging lens (5).

24 Claims, 7 Drawing Sheets

$x = 0.046\,y^2 - y$

FOCUSABLE SPOTLIGHT WITH A NEGATIVE LENS

BACKGROUND OF THE INVENTION

This application claims a priority from German application 100 63 134.7, filed Dec. 18, 2000, and the contents of that application are incorporated herein by reference.

This invention relates to a spotlight of a type having a curved reflector with a lamp arranged inside a cavity formed by the reflector, with the lamp and the reflector being movable relative to one another in a direction of a main optical axis of the spotlight, and with a converging, or collector, lens arranged in front of the reflector in a direction of light emission.

Although such known generic spotlights have a good luminous efficiency, they are not focusable. The mobility of the lamps in the reflectors are often very limited in these spotlights, and this limited mobility has always served only to find an optimal lamp position at which a most uniform possible light distribution is achieved. When a lamp is outside this optimal position, the generic spotlight supplies a very irregular light distribution with several ring-shaped maximums and minimums in a light intensity distribution. This is the same effect that often occurs with flashlights constructed with a deep, smooth reflector.

According to the state of the art, an attempt has been made to smooth out the irregularities in light distribution in these spotlights by using a corrugated, faceted reflector. However, a directional characteristic of the reflector is lost through such a measure. To correct or alter the light emission characteristics of these generic spotlights, additional collector, or converging, lenses are also used as front lenses, although this entails increased costs for material and labor, because, depending on current lamp settings, the corresponding appropriate front lens must be supplied, selected and used.

Focusable spotlights are also known in the art, but they always operate with shallow, or flat, reflectors, which results in a very poor luminous efficiency, especially at a small light emission angle (spot setting).

It is an object of this invention is to provide a spotlight of the generic type mentioned above, that supplies a high luminous efficiency while at the same time is focusable.

SUMMARY OF THE INVENTION

According to principles of this invention, a spotlight of the generic type described above has a dispersive, or diverging, lens arranged between the reflector and the collector lens.

In a spotlight of this invention, the arrangement of a dispersive lens between the reflector and the converging lens is very important. It is only through this dispersive lens in combination with a movable lamp in the reflector cavity that a desired focusability is obtained, while the deep reflector assures a high luminous efficiency. Although a light distribution in focusing the spotlight of this invention is not perfectly uniform, focusing of spotlights with a comparable luminous efficiency was not possible at all in the prior art.

Various advantageous and preferred embodiments of the spotlight of this invention are also disclosed and claimed herein.

In some preferred embodiments, the focusability of the spotlight is improved even further because of expanded relative movement possibilities. These embodiments are particularly very beneficial because with them variations in the light emission angles are achieved through simple mechanical displacement of optical components of the spotlight. This eliminates entirely a time-consuming replacement of the converging, collector, lens for the purpose of altering the light emission angle. In especially preferred embodiments, a very uniform light distribution is achieved, also with a high luminous efficiency, by coordinating nonlinearity of the displacements of the reflector, the lamp and the dispersive lens for each spotlight setting.

The reflector structure in another preferred embodiment of the spotlight of this invention assures extremely good beam guidance from a standpoint of uniform illumination of an area to be illuminated at each light emission angle.

The special structures of the converging lens and/or the dispersive lens in the preferred embodiments, according to some embodiments, lead to an inventive spotlight having a very small mass. Such a lightweight spotlight of this invention is especially suitable for use on video cameras, where weight plays a crucial role in handling an entire video camera arrangement.

The special structure of the dispersive lens in one preferred embodiment ensures that an area to be illuminated is illuminated especially uniformly at each angle of light emission. Such a purpose is also served by a special structure of the converging lens in one preferred embodiment of the inventive spotlight.

In one especially-preferred embodiment, the dispersive lens, which is structured in this case as an aspherical lens, can carry out a different function with its central part than with its edge area. For example, it is possible to ensure that the entire diameter of the front lens (converging lens) is illuminated in all positions of the optical system. This is especially advantageous when soft shadow edges are to be produced, so that the spotlight of this invention serves as a type of focusable soft light.

BRIEF DESCRIPTION OF THE DRAWINGS

The invention is described and explained in more detail with reference to the drawings. The described and drawn features can be used individually or in preferred combinations in other embodiments of the invention. The foregoing and other objects, features and advantages of the invention will be apparent from the following more particular description of the invention, as illustrated in the drawings in which reference characters refer to the same parts throughout the different views. The drawings are not necessarily to scale, emphasis instead being placed upon illustrating principles of the invention in a clear manner.

DETAILED DESCRIPTION OF THE INVENTION

Figure 1:
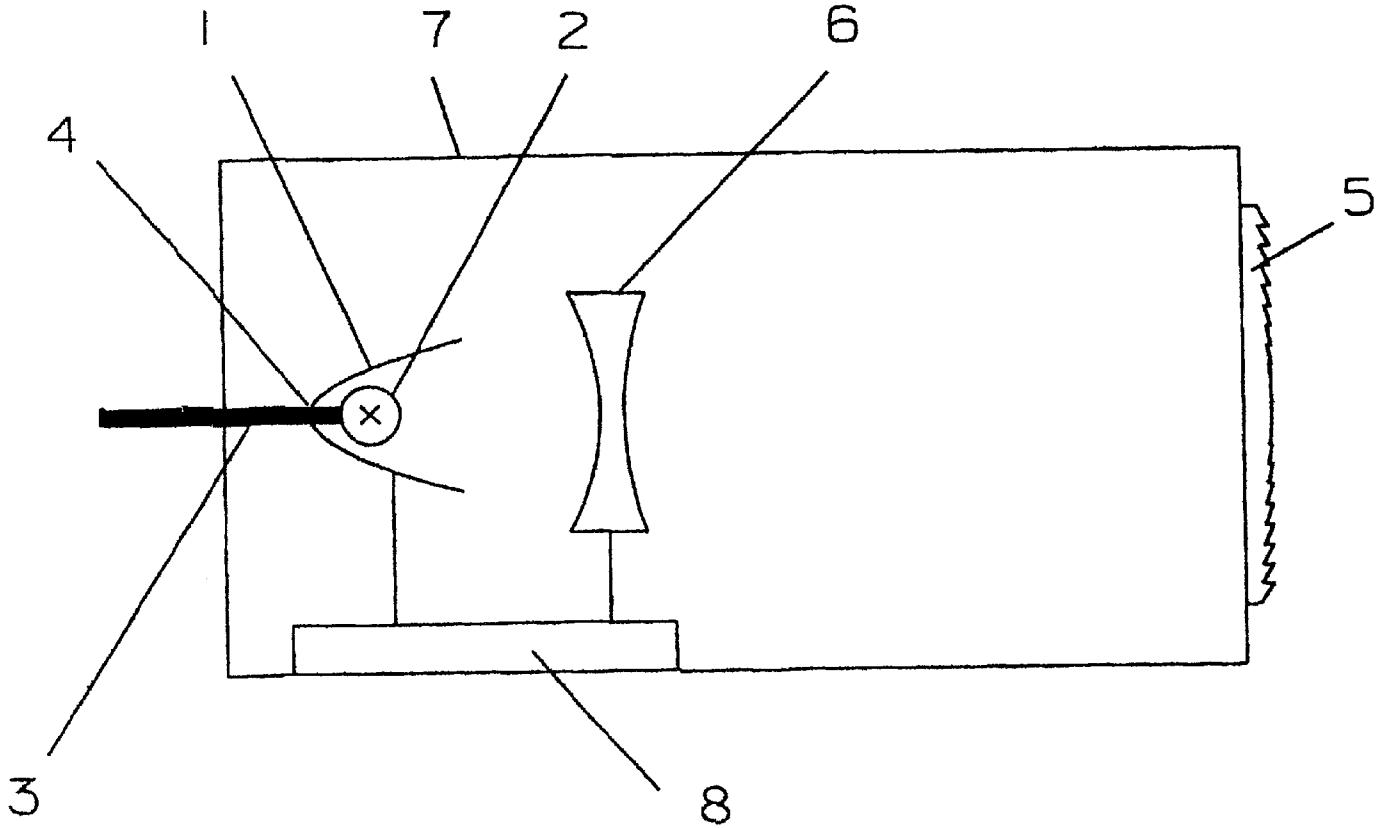
FIG. 1 is a schematic side diagram of a basic structure of one embodiment of a spotlight of this invention with a one-side socket-mount lamp.

The embodiment of the spotlight of this invention illustrated in FIG. 1 has a curved reflector 1 and a lamp 2 arranged inside a cavity formed by the reflector 1. Such a reflector in which the lamp is arranged inside the cavity formed by the reflector is also often referred to as a "deep reflector." The lamp 2 in the embodiment shown here is an incandescent lamp, but instead of an incandescent lamp 2, it could also be a gas discharge lamp or a lamp of a different type.

Lamp 2 is inserted by a one-side socket-mount into a socket-and-movement device 3. The reflector wall has an opening 4 in its rear central area for the socket-and-movement device 3. The lamp 2 is connected to an electric voltage source by way of the socket-and-movement device 3. Furthermore, the socket-and-movement device 3 serves to move the lamp 2 back and forth within the cavity formed by the reflector 1 relative to the reflector 1 in the direction of the main optical axis of the spotlight of this invention.

A converging, collector, lens 5 is arranged in the direction of light-beam emission of reflector-lamp combination 1, 2. A biconcave dispersive lens 6 is located between the reflector-lamp combination 1, 2 and the converging lens 5 in the direction of light-beam emission. The surface of the dispersive lens 6, which faces the lamp 2, has been subjected to a special surface treatment and consequently it has a micro-lens structure.

The converging lens 5 is a Fresnel lens made of resinous plastic.

In the embodiment of the spotlight of this invention shown here, the converging lens 5 is mounted in a fixed position on a spotlight housing 7. The reflector 1 and the dispersive lens 6 are mounted in a fixed position on a carriage 8, which can be moved back and forth as such along the direction of the optical axis of the spotlight. In this way, in the embodiment of the spotlight of this invention shown here, the reflector 1 and the dispersive lens 6, while retaining their mutual spacing, on the one hand, can be moved in the direction of the main optical axis of the spotlight relative to the converging lens, on the other hand. The flood position of the spotlight is obtained when the carriage 8 is in its closest possible position near to the converging lens 5, the position being predetermined by structure of the spotlight. The spot position is obtained at the farthest possible distance of the carriage 8 from the converging lens 5, which is determined by the structure of the spotlight.

Figure 2:
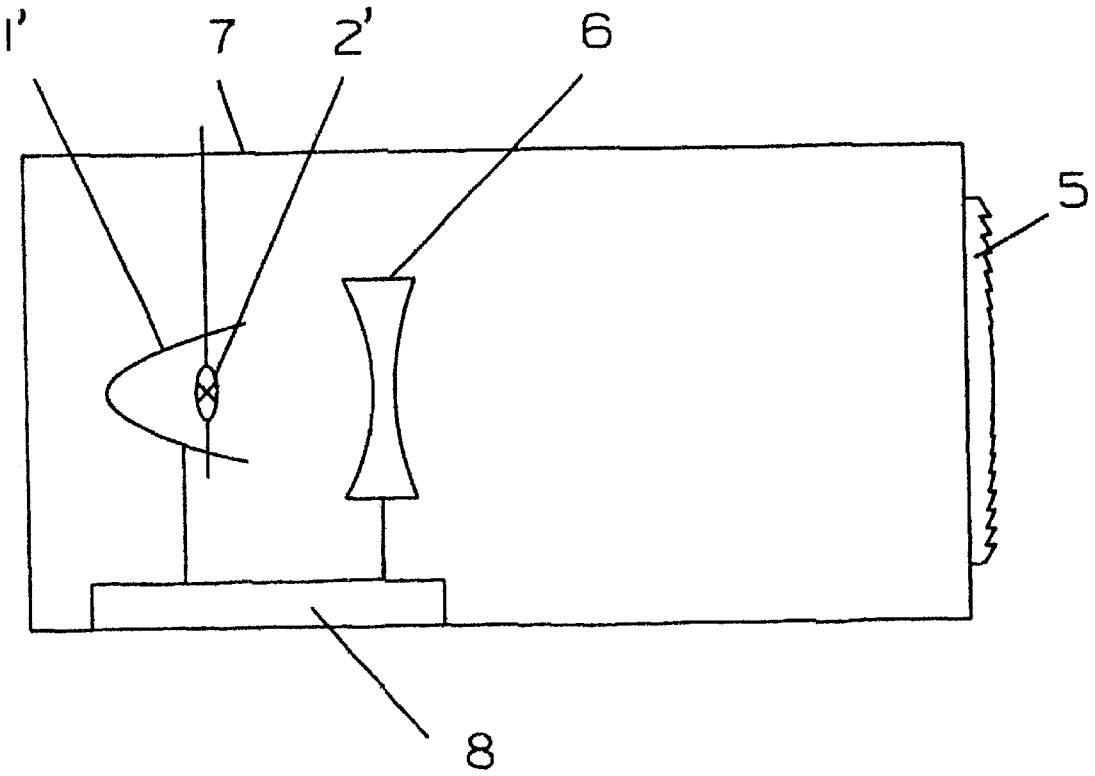
FIG. 2 is a schematic side diagram of a basic structure of another embodiment of a spotlight of this invention with a two-side socket-mount lamp.

The embodiment of the spotlight of this invention illustrated in FIG. 2 corresponds essentially to the embodiment in FIG. 1. The difference is that in the embodiment in FIG. 2, the rear center of the reflector 1' is closed, and the lamp 2' has a two-side lamp socket-mount. The reflector wall has two guide slots to receive and guide movement of the two-side lamp socket-mount. In this embodiment, the lamp 2' is also movable relative to the reflector 1' in the direction of the main optical axis of the spotlight inside the cavity formed by the reflector 1'.

Figure 3:
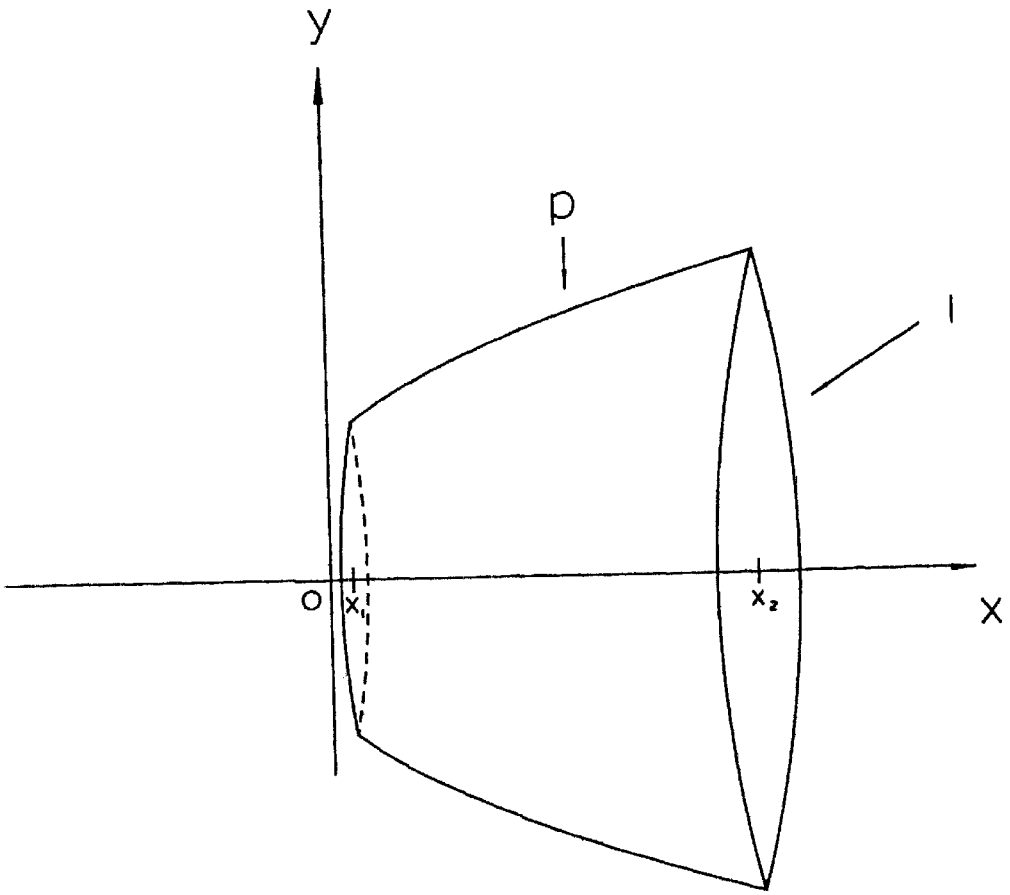
FIG. 3 is a schematic perspective diagram of the structure of a reflector in the embodiment of FIG. 1.
Figure 4:
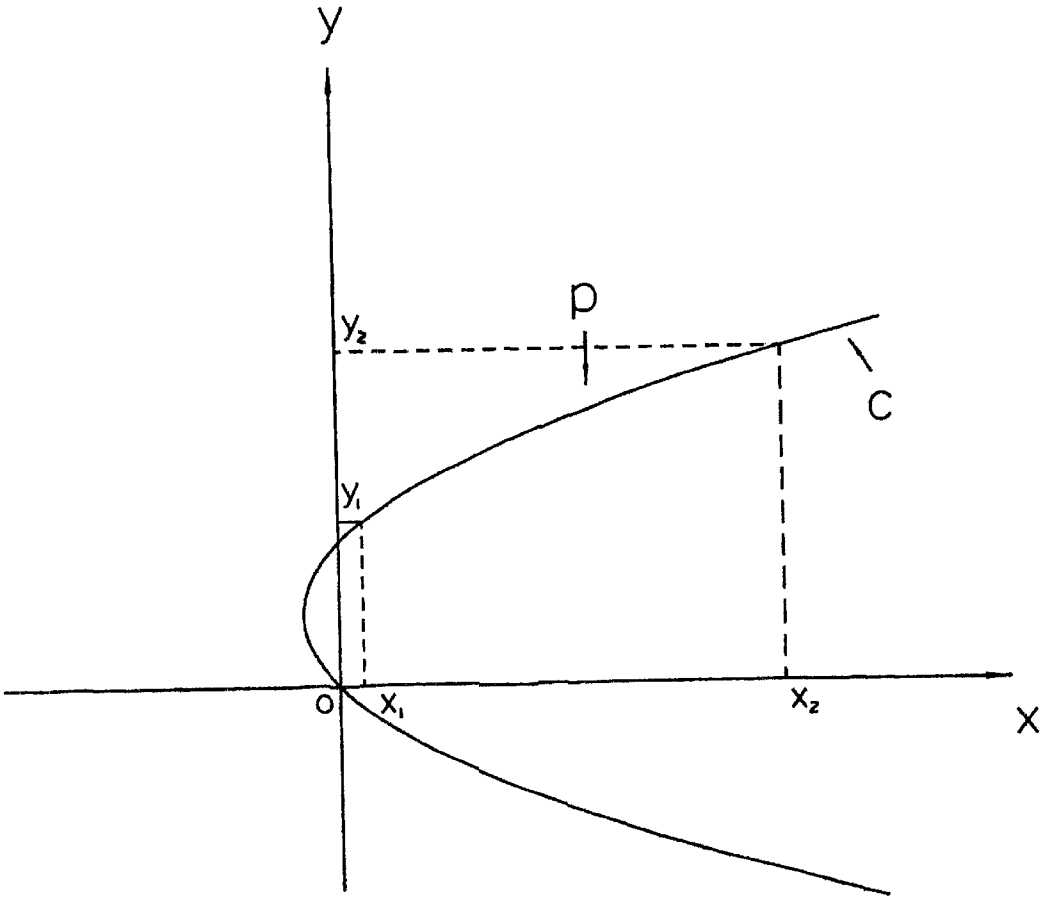
FIG. 4 is a mathematical construction detail to complement FIG. 3, and Each of FIGS. 5*a* through 5*c* is a schematic side view of another embodiment of the spotlight of this invention, each showing a different displacement in a range from a flood position (FIG. 5*a*) to a spot position (FIG. 5*c*).

FIG. 3 shows schematically the structure of the reflector 1 of the embodiment of the inventive spotlight of FIG. 1. The reflector 1 is a rotational body whose shape comes about through rotation of a curved section P about the main optical axis of the spotlight. The main optical axis of the spotlight is represented by the x-axis in the coordinate system in FIG. 3. The curved section P is a curved section of a smooth curve C that can be described by a polynomial function. This curve C is illustrated in FIG. 4. The following equation holds for C:

$$x=0.046\,y^2-y$$

where $y \in R$.

P is equal to C within the limits $[y_1, y_2]$. As shown in FIG. 4, an apex, or apsis, of C does not lie on the main optical axis of the spotlight.

With regard to the mechanical mobility of the optical components of the inventive spotlight relative to one another, there are a variety of other embodiments. For example, there is one embodiment of the spotlight of this invention that is structured so that the dispersive lens carries out movements relative to the reflector in coordination with a simultaneous relative movement between the light source (lamp) and reflector and a simultaneous third movement of the lamp, reflector and dispersive lens in relation to the converging lens.

Figure 5A:
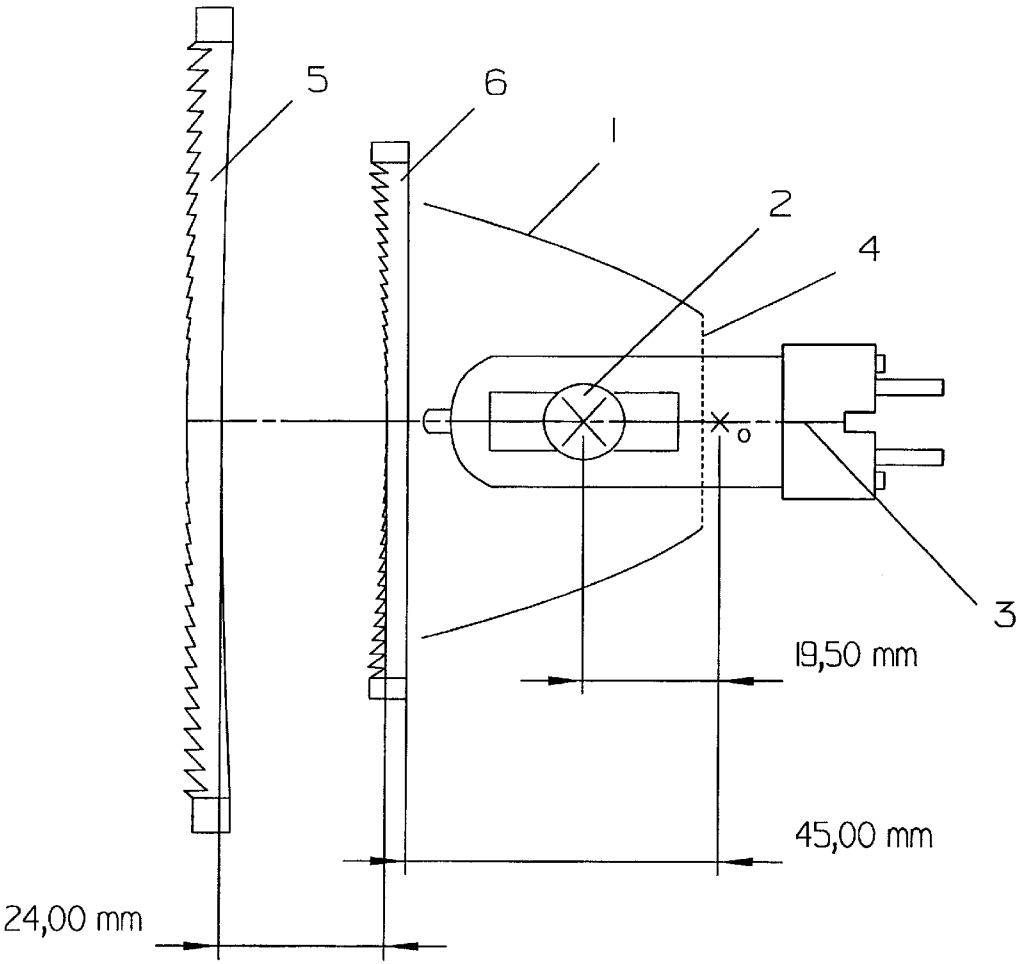
Figure 5B:
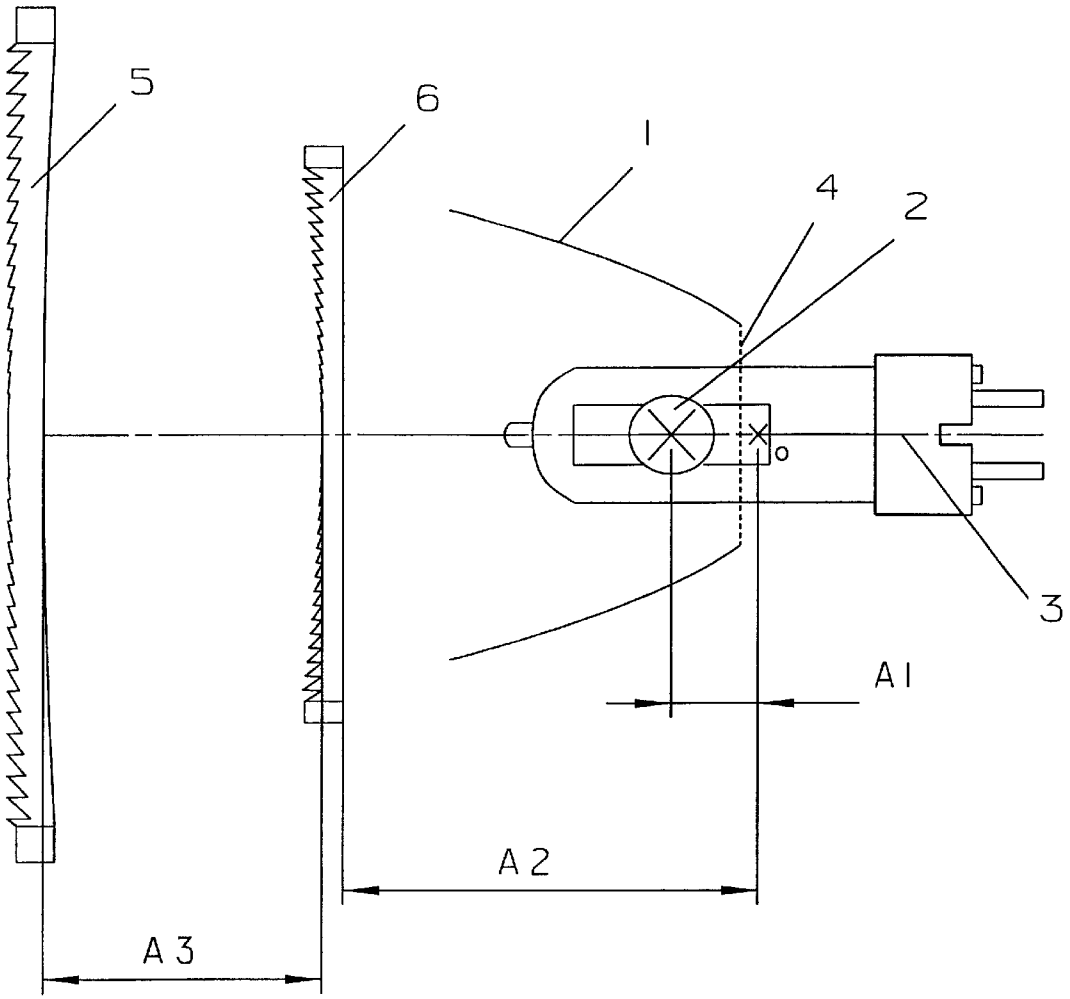
Figure 5C:
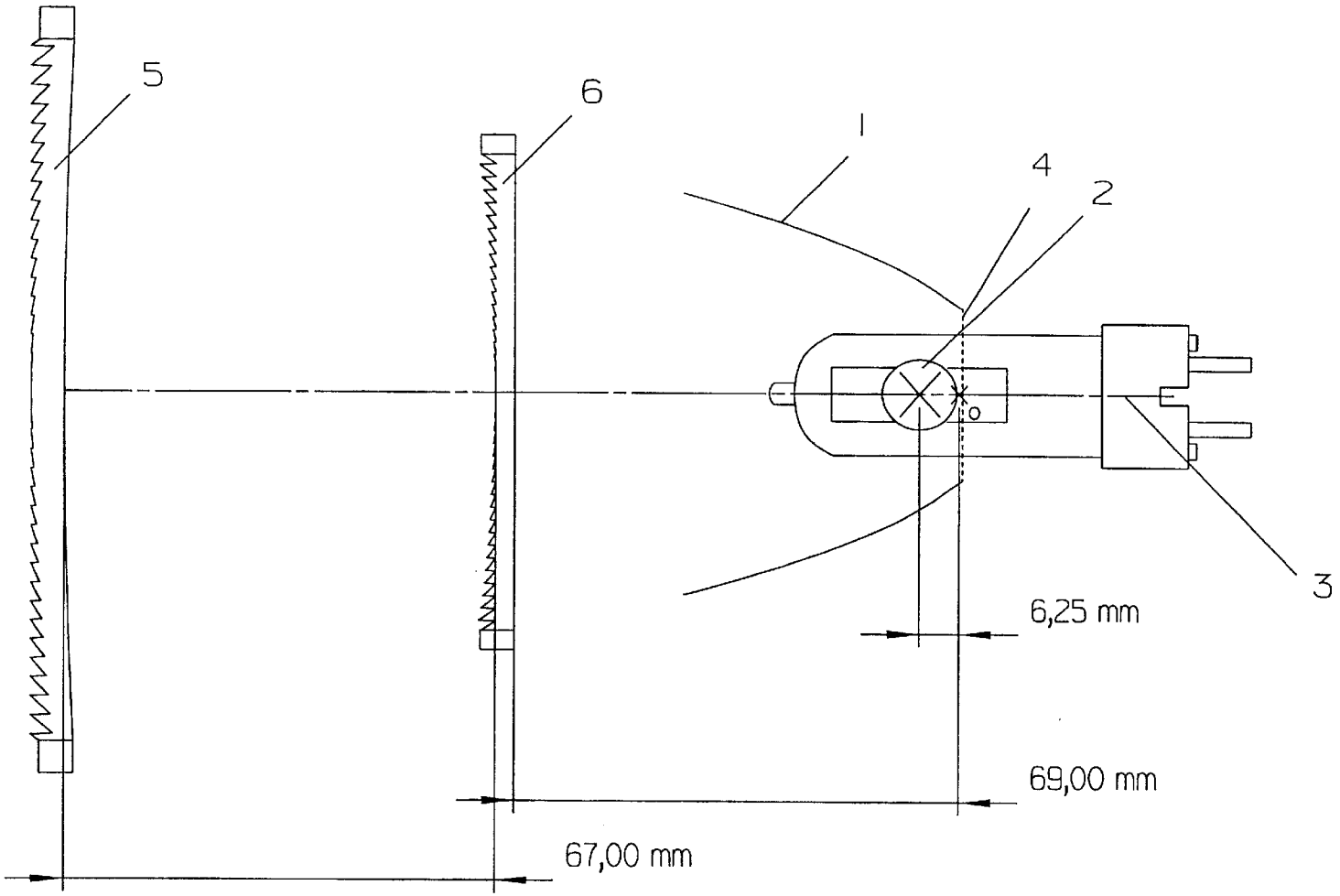

In the embodiment of the spotlight of this invention, illustrated in FIGS. 5*a* through 5*c*, the lamp 2 is inserted into a socket on one end of a socket-and-movement device 3. The reflector wall has an opening 4 in its rear central area for the socket-and-movement device 3. The embodiment of the spotlight of this invention, as illustrated in FIGS. 5*a* through 5*c*, thus corresponds essentially to the embodiment of FIG. 1 in this regard, although the concrete details of the lamp 2 and the socket-and-movement devices 3 differ in structure, as is already apparent from the purely schematic drawings. However, the mathematical structure of the reflector 2 in the embodiment of FIGS. 5*a* through 5*c* corresponds to the structure of reflector 2 from the embodiment in FIG. 1, as explained above with respect to FIGS. 3 and 4.

In the embodiment of the spotlight of this invention illustrated in FIGS. 5*a* through 5*c*, both the converging lens 5 (front lens) and the dispersive lens 6 are structured as Fresnel lenses. The reflector 1 is displaceable, or movable, in the direction of the main optical axis of the spotlight. The lamp 2 is also displaceable in the direction of the main optical axis of the spotlight. Likewise, the dispersive lens 6 is displaceable in the direction of the main optical axis of the spotlight. In displacement from the flood setting to the spot setting of the spotlight, the dispersive lens 6 is shifted away from the converging lens 5, the reflector 1 is shifted away from the dispersive lens 6, and the lamp 2 is shifted into the reflector 1. In displacement from the spot setting to the flood setting of the spotlight, this sequence of movements takes place in exactly the opposite order. Three settings of this displacement sequence are illustrated in FIGS. 5*a* through 5*c*, where FIG. 5*a* illustrates the flood setting, FIG. 5*c* the spot setting and FIG. 5*b* a setting between the flood setting and the spot setting.

The particular characteristic of the embodiment of the spotlight of this invention illustrated in FIGS. 5*a* through 5*c* is that this spotlight is structured so that the above-mentioned displacement of the reflector 1, the lamp 2 and the dispersive lens 6 is carried out by a unitary movement mechanism in a predetermined coordinated manner so that, when seen over a complete displacement between the flood setting and the spot setting of the spotlight, with this complete displacement being subdivided into multiple displacement sections, there is no linear relationship between the respective displacement lengths of the reflector 1, the lamp 2 and the dispersive lens 6. This is made clear by the following table which summarizes the respective relative spacings of the lamp 2 from the reflector 1 (distance A1), the dispersive lens 6 from the reflector 1 (distance A2) and the front lens 5 from the dispersive lens 6 (distance A3). Reference is made to FIG. 5*b* with regard to determination of spacings A1, A2 and A3.

| A1 Distance between lamp and reflector - in mm | A2 Distance between dispersive lens and reflector - in mm | A3 Distance between front lens and dispersive lens - in mm |
|---|---|---|
| 19.5 | 45 | 24 |
| 19 | 47 | 26 |
| 18 | 48 | 35 |
| 17 | 50 | 40 |
| 16 | 53 | 46 |
| 15 | 57 | 50 |
| 14 | 60 | 56 |
| 13 | 62 | 59 |
| 12 | 63 | 61 |
| 11 | 64 | 62 |
| 10 | 65 | 63 |
| 9 | 66 | 64 |
| 8 | 67 | 65 |
| 7 | 68 | 66 |
| 6.25 | 69 | 67 |

As the preceding table shows, the last-described embodiment of the inventive spotlight is structured so that with displacement from the flood setting to the spot setting, the distance between the dispersive lens 6 and the converging lens 5 increases more in an approximate middle partial section of the displacement than the distance between the reflector 1 the dispersive lens 6, while in a partial section of the displacement directly before the spot setting, the distance between the dispersive lens 6 and the converging lens 5 and the distance between the reflector 1 and the dispersive lens 6 increase in approximately the same manner. The situation is similar with regard to the distance between the reflector 1 and the dispersive lens 6 and the displacement of the lamp 2 into the reflector 1 (distance A1). During displacement from the flood position to the spot position in approximately the middle partial section of the displacement, the distance between the reflector 1 and the dispersive lens 6 (distance A2) increases more than the displacement of the lamp 2 into the reflector 1 (distance A1).

Those skilled in the art will be familiar with possible mechanical embodiments from the prior art for the unitary, or uniform, movement mechanism, which can execute the displacement of the reflector 1, the lamp 2 and the dispersive lens 6 in the predetermined coordinated manner set forth here, and production of such a unitary movement mechanism belongs to the field of conventional abilities for those skilled in the art. Therefore, a detailed description of a corresponding movement mechanics is not necessary here.

We claim:

1. A spotlight having a curved reflector (1, 1') and a lamp (2, 2') arranged inside a cavity formed by the reflector (1, 1'), with the lamp (2, 2') and the reflector (1, 1') being movable relative to one another in a direction of a main optical axis of the spotlight, and a converging lens (5) arranged in front of the reflector (1, 1') in a direction of light emission, wherein a dispersive lens (6) is arranged between the reflector (1, 1') and the converging lens (5).

2. The spotlight of claim 1, wherein the reflector (1, 1') is movable with the lamp (2, 2') in the direction of the main optical axis of the spotlight.

3. The spotlight of claim 1, wherein the dispersive lens (6) is movable in the direction of the main optical axis of the spotlight.

4. The spotlight of claim 1, wherein the reflector (1, 1') and the dispersive lens (6) are movable together in the direction of the main optical axis of the spotlight.

5. The spotlight of claim 1, wherein a rear central area of a reflector wall is closed, the lamp (2') has a two-side socket mount, and the reflector wall has two guide slots to receive and guide movement of the two-side socket mount.

6. The spotlight of claim 1, wherein at least one of the converging lens (5) and the dispersive lens (6) is a Fresnel lens.

7. The spotlight of claim 1, wherein at least one of the converging lens (5) and the dispersive lens (6) is a resinous plastic lens.

8. The spotlight of claim 1, wherein at least one of the surfaces of the dispersive lens (6) in the path of the beam has a micro-lens structure.

9. The spotlight of claim 1, wherein the dispersive lens (6) is an aspherical lens.

10. The spotlight of claim 1, wherein at least a portion of the surface of the converging lens (5) has a micro-lens structure.

11. The spotlight of claim 1, wherein each of the converging lens (5) and the dispersive lens (6) is a Fresnel lens.

12. The spotlight of claim 1, wherein each of the converging lens (5) and the dispersive lens (6) is a resinous plastic lens.

13. The spotlight of claim 1, wherein a reflector wall of the reflector has an opening (4) in its rear central area.

14. The spotlight of claim 13, wherein the lamp is movable through the opening (4).

15. The spotlight of claim 13, wherein a socket-and-movement device (3) for the lamp (2) extends through the opening (4).

16. The spotlight of claim 1, wherein the reflector (1) is displaceable in the direction of the main optical axis of the spotlight;

the lamp (2) is displaceable in the direction of the main optical axis of the spotlight;

the dispersive lens (6) is displaceable in the direction of the main optical axis of the spotlight, and during adjustment from a flood setting toward a spot setting of the spotlight, the dispersive lens (6) is displaced away from the converging lens (5), the reflector (1) is displaced away from the dispersive lens (6), and the lamp (2) is displaced into the reflector (1), with the spotlight being structured so that said displacements of the reflector (1), the lamp (2) and the dispersive lens (6) are carried out by a unitary movement mechanism in a predetermined and coordinated manner such that, when seen over a complete displacement between the flood setting and the spot setting of the spotlight, with a subdivision of this complete displacement into multiple displacement sections, there is no linear relationship between the respective displacement lengths of the reflector (1), the lamp (2) and the dispersive lens (6).

17. The spotlight of claim 16, wherein the spotlight is structured so that during an adjustment from the flood setting to the spot setting, at least during a portion of the adjustment, spacing between the dispersive lens (6) and the converging lens (5) increases to a greater extent than does a spacing between the reflector (1) and the dispersive lens (6).

18. The spotlight of claim 16, wherein the spotlight is structured so that during an adjustment from the flood setting to the spot setting, a spacing between the reflector (1) and the dispersive lens (6) increases to a greater extent, at least during a portion of the adjustment, than does a displacement of the lamp (2) into the reflector (1).

19. The spotlight of claim 1, wherein a shape of the reflector (1, 1'), except for a central rear area thereof, is generated by rotation of a curved section (P) about the main optical axis of the spotlight, said curved section P being a curved section of a smooth curve (C), which can be described by a polynomial function, and if the curve (C) has only a single apsis, said apsis being away from the main optical axis of the spotlight.

20. The spotlight of claim 19, wherein the smooth curve (C) conforms to the following functional relationship:

$$X=ay^2-y$$

where $a, y \in R$.

21. The spotlight of claim 20, wherein the a has a value of 0.046.

22. The spotlight of claim 19, wherein a shape of the reflector (1, 1') is generated by rotation of a curved section (P) about the main optical axis of the spotlight, said curved section P being a curved section of a smooth curve (C), which can be described by a polynomial function, and if the curve (C) has only a single apsis, said apsis being away from the main optical axis of the spotlight.

23. The spotlight of claim 20, wherein the smooth curve (C) conforms to the following functional relationship:

$$X=ay^2-y$$

where $a, y \in R$.

24. The spotlight of claim 23, wherein the a has a value of 0.046.

* * * * *